US007015387B2

(12) United States Patent
Chen

(10) Patent No.: US 7,015,387 B2
(45) Date of Patent: Mar. 21, 2006

(54) IN-LINE CHROMATIC HARP WITH AN ADJUSTABLE STRING GUIDE

(76) Inventor: Philip Ling Chen, 8 Ringbit Rd. E., Rolling Hills, CA (US) 90274

( * ) Notice: Subject to any disclaimer, the term of this patent is extended or adjusted under 35 U.S.C. 154(b) by 24 days.

(21) Appl. No.: 10/822,289

(22) Filed: Apr. 12, 2004

(65) Prior Publication Data

US 2005/0223873 A1 Oct. 13, 2005

(51) Int. Cl.
*G10D 1/04* (2006.01)

(52) U.S. Cl. ..... 84/264; 84/470 R

(58) Field of Classification Search ..... 84/264, 84/265, 470 R, 471 R, 472–475, 471 SR, 84/476, 477 R, 478, 479 R, 480
See application file for complete search history.

(56) References Cited

U.S. PATENT DOCUMENTS 5,140,883 A * 8/1992 Fay ..... 84/266
6,870,085 B1 * 3/2005 MacCutcheon ..... 84/477 R

* cited by examiner

*Primary Examiner*—Kimberly Lockett

(57) ABSTRACT

The invention provides an in-line chromatic harp including a body, a plurality of strings and a string position guide. The body is formed of a pillar, a neck and a sound box. The strings run from the neck to the sound box. The string position guide is movably installed behind the strings, with one end fixed to the pillar and the other end to the neck. This allows a harp player to quickly identify the proper string for each note and to play any chromatic scale as if playing the "C major" scale.

9 Claims, 2 Drawing Sheets

IN-LINE CHROMATIC HARP WITH AN ADJUSTABLE STRING GUIDE

BACKGROUND OF THE INVENTION

1. Field of the Invention

This invention relates to an in-line chromatic harp, and more particularly to an in-line chromatic harp with an adjustable string position guide which allows a harp player to quickly identify the proper string for each note and to play any chromatic scale as if playing the C major scale.

2. Description of the Related Art

An in-line chromatic harp is a string instrument which has the entire twelve semitones in an octave, like the piano, and therefore versatile in music performance. Its strings, like most harps, are arranged in one line. Since in each octave of the in-line chromatic harp has twelve strings instead of seven in a conventional harp, the string spacing is narrower so that each octave will not become too wide for the hands of the harp player. There are chromatic harps designed with two rows of strings, either parallel or cross each other to preserve the string spacing of conventional harp. These harps had their position in the history and have been around for centuries.

The advantage of an in-line chromatic harp is that every one of the twelve semitones in each octave are accessible from the finger tips without any additional mechanical movement such as pushing a foot pedal or moving a lever, which is the standard practice for harp playing. For example, the concert harp requires the player to push one of several pedals in order to play a # or b (sharp or flat) note. For lever harp, the player has to flip a lever to achieve the same result. These require skills and training. It also limits the music one can play and often the music may need to be re-composed to suit the instrument.

The in-line chromatic harp is, however, not without problems or difficulties, either. The most serious problem is that for the in-line chromatic harp the spacing between any two strings is generally narrower than the conventional harp. The standard color codes, red for "C" string and blue for "F" string, are no longer adequate for the purpose of indicating the string position because there are too many strings in between. The regular harp has only two white strings between the red string and blue string, and three white strings between blue string and red string; therefore, there is no difficulty in identifying the location of any note or string. On the other hand, the in-line chromatic harp, if using the same color code to identify the "C" and the "F" strings, there will be four narrowly spaced white strings between the "C" and the "F" strings, and six narrowly spaced white strings between the "F" and the "C" strings. This arrangement becomes rather difficult to play because of the excessive number of the closely spaced strings.

U.S. Pat. No. 2,137,160 discloses a guide to be disposed just behind the string with the same white and black key arrangement like the piano key so that anyone skilled in playing piano or organ can readily acquire proficiency in playing a harp with the guide.

BRIEF SUMMARY OF THE INVENTION

It is therefore an object of the invention to provide an in-line chromatic harp with an adjustable string position guide, wherein the adjustable string position guide is rotatable.

To achieve the above-mentioned object, the invention provides an in-line chromatic harp including a body, a plurality of strings and an adjustable string position guide. The body is formed of a pillar, a neck and a sound box. The strings run from the neck to the sound box. The adjustable string position guide is movably installed behind the strings, with one end fixed to the pillar and the other end to the neck. A plurality of color dots is disposed on the surface of the string position guide and arranged in a specific pattern.

The advantages of this invention will hereinafter become more readily apparent from the following specification and the enclosed drawings.

DETAILED DESCRIPTION OF THE INVENTION

Figures 1, 2:
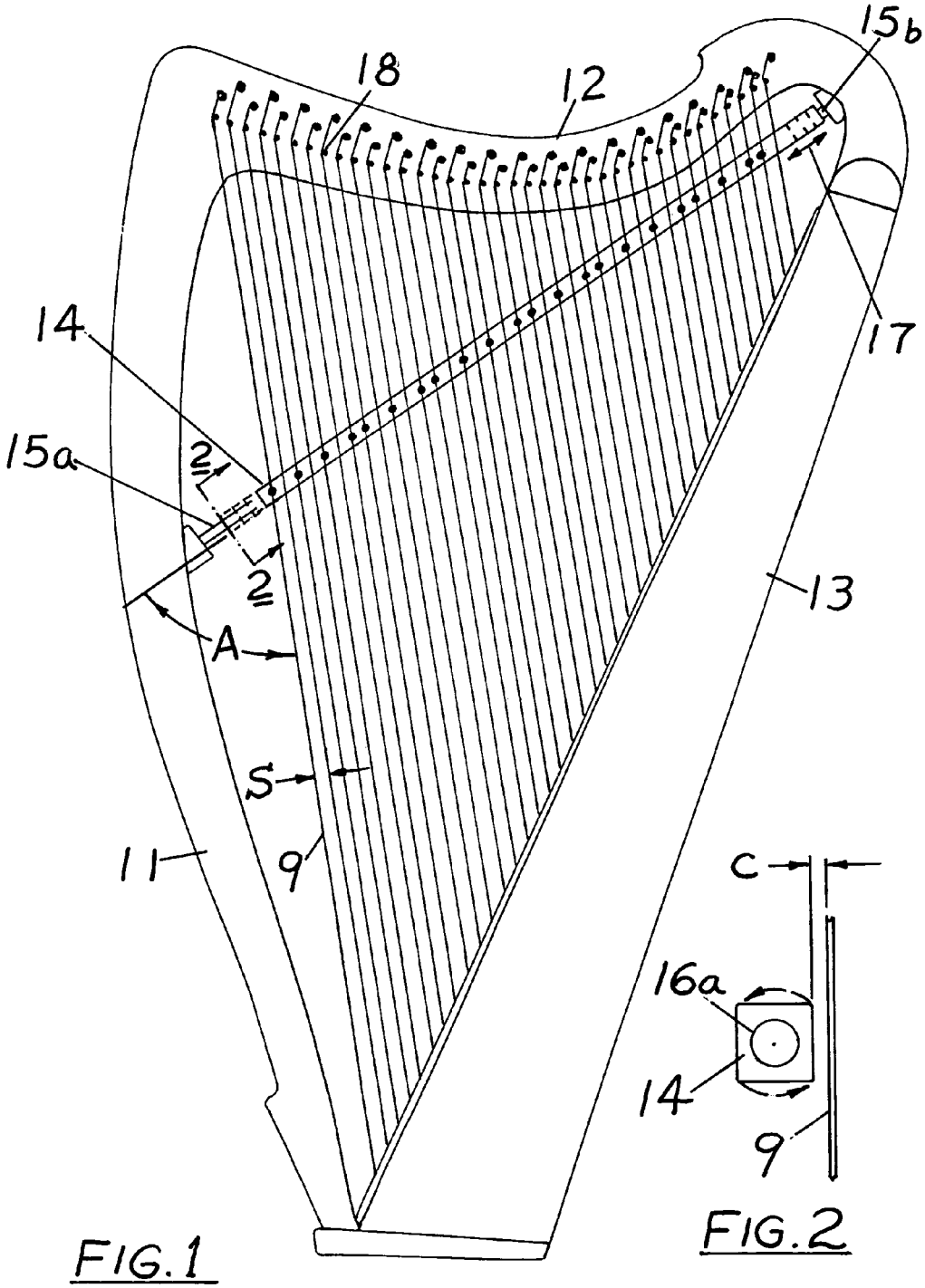
FIG. 1 is a full side view of the invention.
FIG. 2 is a cross-sectional view of the section 2—2.

FIG. 1 is a full side view of the invention, where the pillar 11, neck 12, sound box 13, and the strings 9 and bridge pin 18 are typical of a Celtic folk harp. The adjustable string position guide 14 is shown installed a small distance C behind the strings as shown on FIG. 2, so the string position guide 14 will not interfere with the vibration of the strings 9. The string position guide 14 is mounted on the harp at an angle A to the strings 9 as shown in FIG. 1. The string position guide 14 is positioned right above the proper finger position for playing the harp so the string position is easily identified with this arrangement.

FIG. 2 is a cross-sectional view of section 2—2. Only the cross section of the adjustable string position guide 14 is shown here at a small distance C behind the strings 9. The string position guide 14 depicted here is a square bar or a four sided bar. The bar can also be a triangular or hexagonal prism, and the same principle applies. For the sake of simplicity, from now on a square bar will be used in this specification except where further clarification is necessary.

Figure 3:
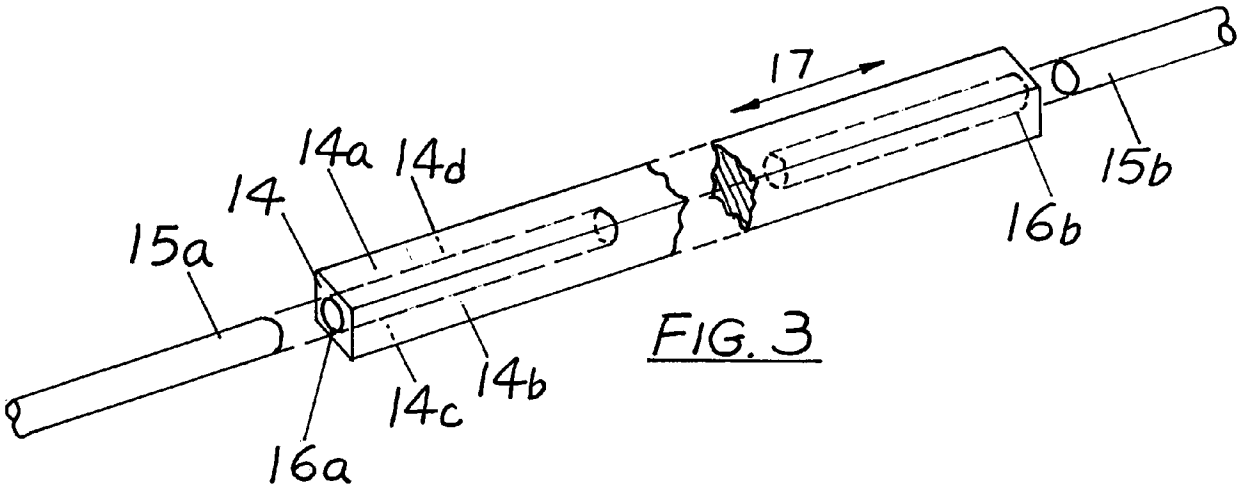
FIG. 3 is a perspective view of the structure of the string position guide of the invention.

FIG. 3 shows a perspective view of the string position guide 14 with the pivot/slide pins 15*a* and 15*b* which are fastened on the pillar 11 and the neck 12 as shown on FIG. 1, and with corresponding pivot/sliding holes 16*a* and 16*b* which are drilled into each end of the string position guide 14. On each side of the string position guide 14 there are multiple dots of different colors forming a special pattern which will be described later. Since the string position guide 14 is not perpendicular to the strings 9, a string spacing L on the string position guide 14 is equal to a true string spacing S, as shown on FIG. 1, divided by sine of the angle A, defined by the strings 9 and the string position guide 14 as shown on FIG. 1. Since the string spacing L on this harp is constant throughout the whole range, which is different from most harps, and therefore the string position guide 14 can slide in a axial direction, as shown by an arrow 17, without mismatching the color dot position to the strings 9 as we will see later the significance of this feature.

Figure 4:
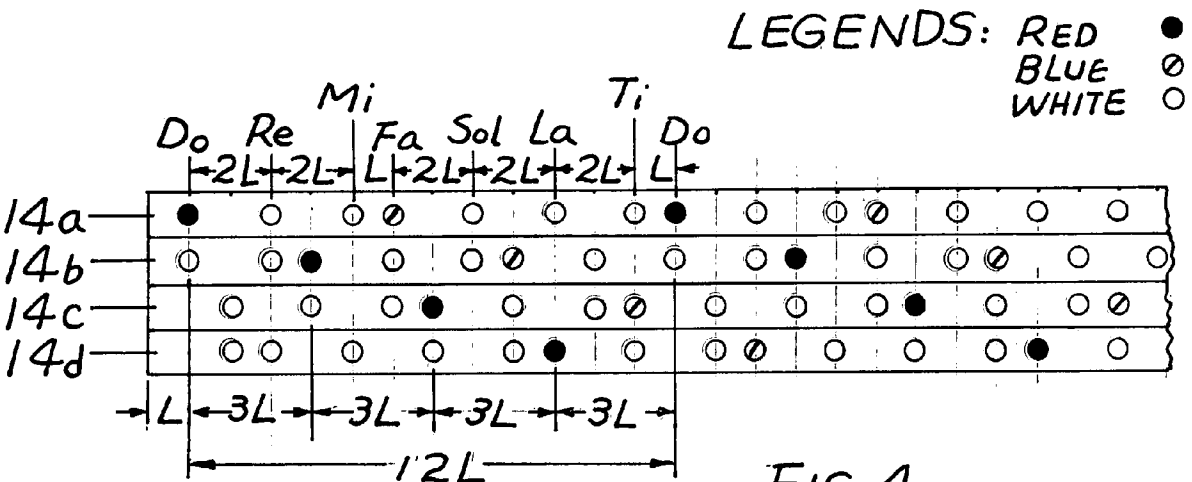
FIG. 4 is a drawing of the color dot patterns on the string position guide of the invention.

The detailed layout of the color dot patterns on the square bar is shown on FIG. 4. The color dot patterns for the four sides 14*a*, 14*b*, 14*c* and 14*d* of the square bar are being put side by side to show the inter relationship of the dot patterns.

On the first side 14*a* of the square bar, the color dots are arranged in the following way:

First dot is red and is located at distance L from the left end. The second dot is white and is located at distance 2L from the first dot. The third dot is also white and located at distance 2L from the second dot. The fourth dot is blue and located at distance L from the third dot. The distance between fourth and fifth is 2L, fifth and sixth is 2L, and sixth and seventh is 2L. The distance between seventh and eighth is L. The spacing repeats itself for the rest of the surface, in this case, for three times. However, this should not be the limit and it depends on how many octaves the harp has. As it is shown on FIG. 4, the first red dot represents the position for Do, the second dot for Re, the third dot for Mi, the fourth dot, a blue dot for Fa, the fifth dot for Sol, the sixth dot for La, and the seventh dot for Ti, and the eighth dot, a red dot again, back to Do of one octave higher. This color code arrangement is the same as a standard harp string color code, that is two white strings between red and blue string and three white strings between blue and red string and this makes the learning transition from a standard harp to this new in-line chromatic harp fairly easy.

The side 14*a* is the first side of four sides which can be used for string position guide. The second side 14*b*, the third side 14*c*, and the fourth side 14*d* can be switched into position by turning the square bar on its pivots 15*a* and 15*b* within the holes 16*a* and 16*b* as the arrows indicated in FIG. 2.

On the second side 14*b*, the dot spacing pattern is the same as 14*a* except the first red dot is shifted a distance of 3L to the right as shown in FIG. 4. On the third side 14*c*, the first red dot is shifted a distance of 6L to the right as shown in FIG. 4. On the fourth side 14*d*, the first red dot is shifted a distance of 9L to the right as shown in FIG. 4. If the string position guide 14 is a triangular bar the red dot lateral shift will be 4L from one side to the next side. If the string position guide 14 is a hexagonal bar the red dot lateral shift will be 2L from one side to the next side.

It becomes apparent that, by turning the string position guide 14 90 degrees from one side to the next side, the position of "Do" is shifted up or down three half-tones depends upon the direction of turning. If the string position guide 14 is a triangular bar, the turning will be 120 degree, and if the string position guide 14 is a hexagonal bar, the turning will be 60 degrees.

The string position guide 14 is held by two pivot pins 15*a* and 15*b* inside the holes 16*a* and 16*b*. The holes are deep enough so that the string position guide 14 can slide axially up and down by at least three L as shown by the arrow 17 on FIGS. 1 and 3. This allows the first red dot or "Do" to be set at any of the three positions at each side of the string position guide 14. If the guide 14 is a triangular bar, the axial movement will need to be at least four L, if the guide 14 is a hexagon bar, the movement will need to be at least 2L.

The result of this arrangement will allow "Do" on this string position guide to be placed at any one of the twelve possible positions of the chromatic music scale required by music.

Since the patterns of the dot arrangement on all four sides are the same, except that the dots for each pattern are being shifted right or left, the finger position, once learned by the player, would be the same no matter in what "key" the music is written. This is a tremendous simplification in playing music. In fact, this makes playing this in-line chromatic harp a lot easier than learning how to play piano, especially for music composed in a scale, other than "C Major", with many sharps or flats. This is an instrument for an amateur to play like a professional without a long and tedious learning process.

The color dot patterns on the string position guide 14 can be made in black and white, as described in U.S. Pat. No. 2,137,160, and shifted three half-tone from one side to the next side. Further, anyone can play the harp of the present invention with music playing simplified and without the complicated usage of the black keys when the music is not written in "C major".

A special color mark (red is preferred in this case) is placed on the bridge pin 18, as depicted on FIG. 1, of the middle C string to identify the starting reference point of the string position guide 14. This position designates the location of the central note for the "C Major" scale.

The beauty of this invention is that there is no mechanical motion to change the string length to achieve semi-tones like either the pedal harp or the lever harp. To slide the guide up or down a fraction of an inch, or to turn the guide around its pivot is very simple without even touching the string and yet the chromatic music scale is transposed up and down at the player's wish with minimal effort.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

The invention claimed is:

1. An in-line chromatic harp, comprising:

a body, formed of a pillar, a neck and a sound box;

a plurality of strings with one end fastened to the neck and another end fastened to the sound box;

a string position guide, movably disposed behind the strings, with one end fastened to the pillar and another end fastened to the neck; and a plurality of color dots, disposed on each side of the string position guide and positioned according to chromatic scales, for indicating positions of the strings for notes of different chromatic scales, where the color dots are shifted to the left or to the right from one side to another, wherein the string position guide rotates around the axle thereof, such that different sides of the string position guide are placed behind the strings to indicate the strings for the notes of different scales.

2. The in-line chromatic harp according to claim 1, wherein the string position guide slides up and down along the axis thereof, so the chromatic scale can move up or down.

3. The in-line chromatic harp according to claim 1, wherein two pivot slide pins are respectively disposed on the pillar and on the neck, and two pivot/sliding holes are respectively formed on two ends of the string position guide, wherein the string position guide is fastened to the pillar and the neck with the pivot/slide pins inserting into the pivot/sliding holes.

4. The in-line chromatic harp according to claim 3, wherein depth of each of the pivot/sliding holes is deep enough for the string position guide to slide up and down along the axis thereof.

5. The in-line chromatic harp according to claim 1, wherein shape of the color dots is polygonal.

6. The in-line chromatic harp according to claim 1, wherein shape of the color dots is circular.

7. The in-line chromatic harp according to claim 1, wherein the string position guide is a rod-shaped bar.

8. The in-line chromatic harp according to claim 1, wherein the string position guide comprises two, three, four, or six sides.

9. The in-line chromatic harp according to claim 1, further comprising a plurality of bridge pins disposed on the neck for fastening the strings to the neck, wherein a special mark is placed on one of the bridge pins to indicate the "middle C" string for the "C Major" scale.

* * * * *